US005465135A

United States Patent [19]

Nakagama et al.

[11] Patent Number: 5,465,135

[45] Date of Patent: Nov. 7, 1995

[54] CHARGER CONTROL IN AN ELECTROPHOTOGRAPHIC COPYING APPARATUS

[75] Inventors: Kiyohari Nakagama; Kazuhiro Nakazawa, both of Hachioji, Japan

[73] Assignee: Konica Corporation, Tokyo, Japan

[21] Appl. No.: 209,987

[22] Filed: Mar. 11, 1994

[30] Foreign Application Priority Data

| | | | |
|---|---|---|---|
| Mar. 15, 1993 | [JP] | Japan | 5-054004 |
| Mar. 15, 1993 | [JP] | Japan | 5-054005 |
| Mar. 15, 1993 | [JP] | Japan | 5-054006 |
| Mar. 15, 1993 | [JP] | Japan | 5-054007 |

[51] Int. Cl.[6] ..... G03G 21/00

[52] U.S. Cl. ..... 355/208; 355/219; 355/274

[58] Field of Search ..... 355/208, 215, 355/219, 221, 271, 274, 315

[56] References Cited

U.S. PATENT DOCUMENTS

| | | | |
|---|---|---|---|
| 3,950,680 | 4/1976 | Michaels et al. . | |
| 4,134,147 | 1/1979 | Watanabe . | |
| 4,420,246 | 12/1983 | Nonaka et al. | 355/233 |
| 4,589,765 | 5/1986 | Perun et al. | 355/309 |
| 5,029,314 | 7/1991 | Katsumi et al. | 355/208 |
| 5,142,332 | 8/1992 | Osawa et al. | 355/208 |
| 5,182,603 | 1/1993 | Yamada | 355/208 X |
| 5,198,864 | 3/1993 | Fletcher | 355/274 |
| 5,313,308 | 5/1994 | Hasegawa et al. | 358/406 |

FOREIGN PATENT DOCUMENTS

| | | | |
|---|---|---|---|
| 0415754A1 | 3/1991 | European Pat. Off. . | |
| 3144172A1 | 6/1982 | Germany . | |
| 62-47060 | 2/1987 | Japan | 355/219 |
| 4-190381 | 7/1992 | Japan | 355/219 |

OTHER PUBLICATIONS

Patent Abstracts of Japan, vol. 4, No. 58, (P–9) [540] Apr. 30, 1980 & JP–A–55 28 081 (Ricoh).

*Primary Examiner*—Fred L. Braun

*Attorney, Agent, or Firm*—Frishauf, Holtz, Goodman & Woodward

[57] ABSTRACT

An electrophotographic copying apparatus including a time counter to count a time during which transfer sheets are left in a stacker; a memory to store an output value of a humidity detector; a calculator to calculate a correction value for each transfer sheet in accordance with the output value of the humidity detector and the time counted by the time counter; and a controller to control a corona discharging output for each transfer sheet in accordance with the correction value.

9 Claims, 4 Drawing Sheets

CHARGER CONTROL IN AN ELECTROPHOTOGRAPHIC COPYING APPARATUS

BACKGROUND OF THE INVENTION

The present invention relates to an improvement in output control of a charger (a transfer electrode and a separation electrode) in an electrophotographic copying apparatus, and in particular, to that in output control of a transfer electrode.

Generally, in a copying machine of the type mentioned above, a document placed on a platen glass is illuminated by light of a luminous lamp of a reading section, then, reflected light from the document forms an electrostatic latent image on a photoreceptor (OPC (organic photoreceptor) or the like) drum or a belt charged electrically at high voltage, the electrostatic latent image is developed to be a visible toner image in a developing section, and the toner image is transferred onto a transfer sheet entering a transferring/separating section synchronously with the photoreceptor and the transfer sheet is separated from the photoreceptor to be conveyed to a fixing section where the toner image is fused and fixed through heat fusing on the transfer sheet which is finally collected.

However, when the humidity is high in the place where a copying machine is installed, a resistance value of a transfer sheet is varied due to its moisture absorption. Therefore, even when a stationary electric current at high voltage is given to a transfer electrode, electric charges different in terms of polarity from that in toner which are generated by the high voltage current given do not remain on the transfer sheet but leak along it through grounding, resulting in a transfer failure wherein an image is not transferred normally thus the toner image on the photoreceptor is conveyed to a cleaning section where the toner image is erased fruitlessly. Or, when a high voltage current is intensified for the purpose of correcting the aforementioned failure, the percentage of moisture content of electric charges generated by the high voltage current emerged from the transfer electrode rises and the charges begin to float on the transfer sheet whose electric resistance has been lowered, resulting in blurred transfer wherein the toner image on the photoreceptor is blurred to be transferred onto the transfer sheet.

As a technology for preventing or eliminating the phenomenon mentioned above, Japanese Patent Publication Open to Public Inspection No. 57042/1978 (hereinafter referred to as Japanese Patent O.P.I. Publication) discloses a technology wherein a humidity is measured in a copying machine and is fed back to a power supply for a transfer electrode, Japanese Patent O.P.I. Publication No. 28081/1980 discloses a technology wherein a resistance value of each transfer sheet is measured and is fed back to a power supply for a transfer electrode, and Japanese Patent O.P.I. Publication No. 152267/1980 discloses a technology wherein a high humidity condition is detected and thereby a high voltage current for a charging electrode is controlled.

However, measurement of a resistance value of each transfer sheet brings about disadvantages that a large-scaled mechanism is required and a transfer sheet jam is caused, which is not preferable.

In a technology wherein a humidity is measured and is fed back to a current for transferring or the like, on the other hand, a correlation between a humidity and a current for transferring is fixed equally after measurement of a humidity, leaving the number of sheets stacked out of consideration. Therefore, when transfer sheets in quantity of not less than 20 are conveyed for copying under the condition of a high humidity, a phenomenon of an image quality problem of blurred transfer is caused by an excessive current, which has been a problem.

SUMMARY OF THE INVENTION

An object of the invention is to solve the problem mentioned above and to provide an electrophotographic copying apparatus equipped with a means for controlling transferring and charging wherein transfer failure, blurred transfer and separation failure are not caused even under a high humidity condition, the apparatus is not required to be large in size, and measurement does not cause any jam of transfer sheets.

When such an electrophotographic copying apparatus as that mentioned above is installed in a poorly air-conditioned place in an area of high temperature and high humidity (for example, 33° C. and 85% RH), the percentage of moisture content of a transfer sheet changes and a resistance value thereof changes accordingly if no action is taken for the high temperature and high humidity condition, resulting in transfer troubles. When these troubles are corrected roughly, phenomena such as transfer failure and blurred transfer which deteriorate image quality are brought about. Further, in order for information of the resistance values mentioned above to be maintained accurately for proper operation, both resetting and initializing of such information need to be processed clearly. In addition, transfer sheets having special thickness and materials other than normal thickness and materials are sometimes used, and in such a case, the changes in the percentage of moisture content and resistance values behave naturally in a different way. The object of the invention, therefore, is to provide an electrophotographic copying apparatus wherein a current for transferring and others can be controlled so that high quality images which are stable and are not deteriorated for all transfer sheets having different thickness and materials may be maintained constantly.

The above object can be attained by an electrophotographic copying apparatus of the present invention. The copying apparatus comprises a time counter to count a time during which transfer sheets are left in a stacker; a memory to store an output value of a humidity detector; a calculator to calculate a correction value for each transfer sheet in accordance with the output value of the humidity detector and the time counted by the time counter; and a controller to control a corona discharging output for each transfer sheet in accordance with the correction value.

DETAILED DESCRIPTION OF THE PREFERRED EMBODIMENT

Figure 2:
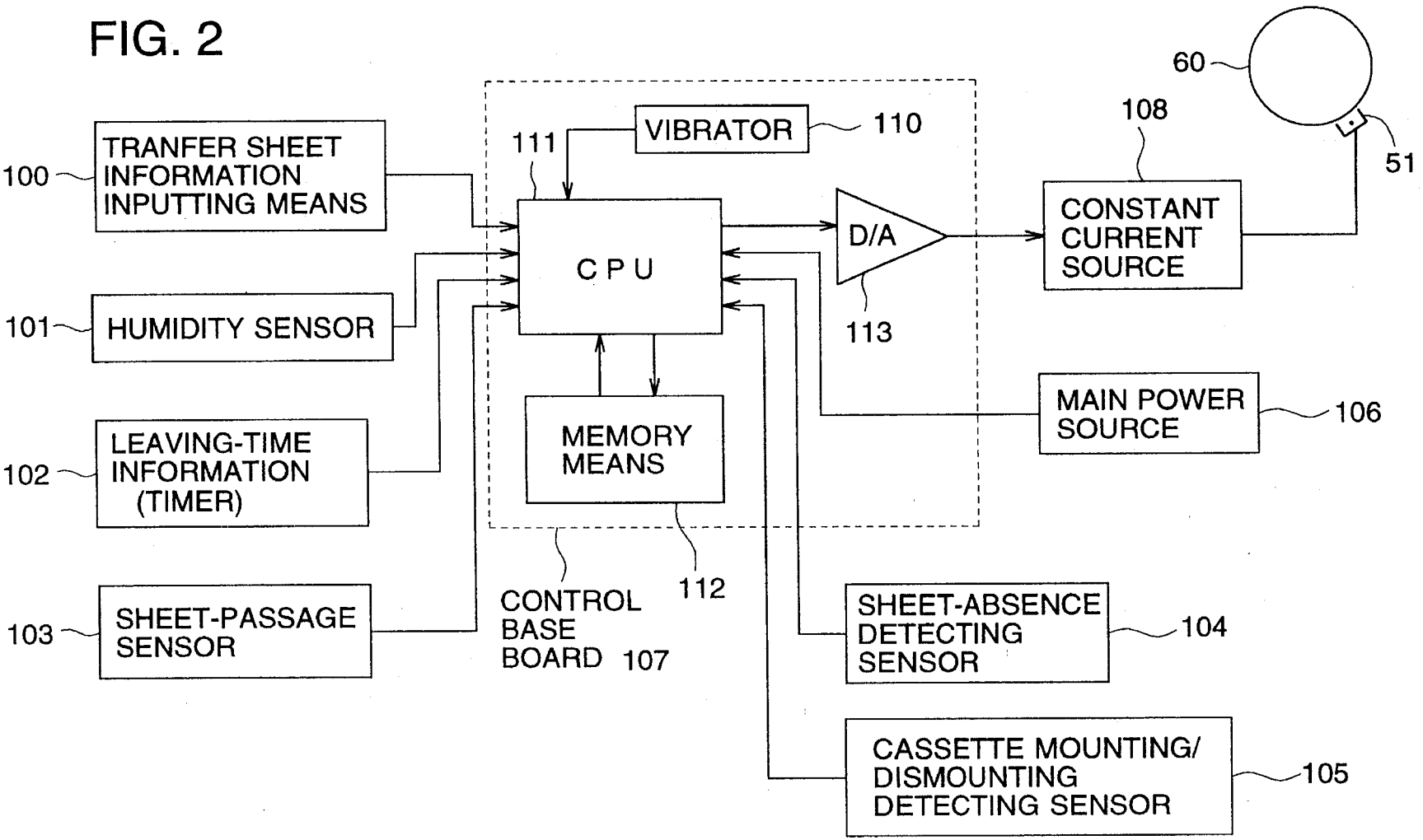
FIG. 2 is a schematic diagram of control circuits of the invention.
Figure 3:
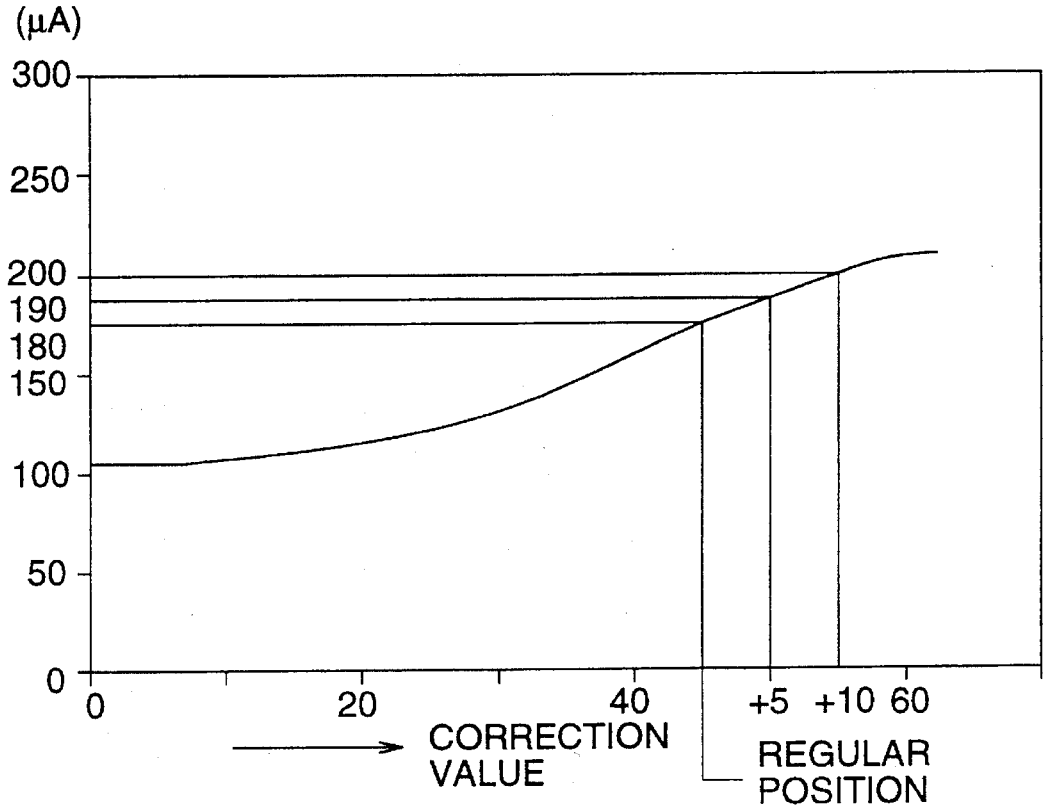
FIG. 3 is a diagram showing a correlation between command values and current values for transferring for a photoreceptor.

An example of the invention will be explained as follows, referring to a general structural diagram in FIG. 1, a schematic diagram of control circuits in FIG. 2 and a diagram in FIG. 3 showing a correlation between command values and current values for transferring for a photoreceptor.

Figure 1:
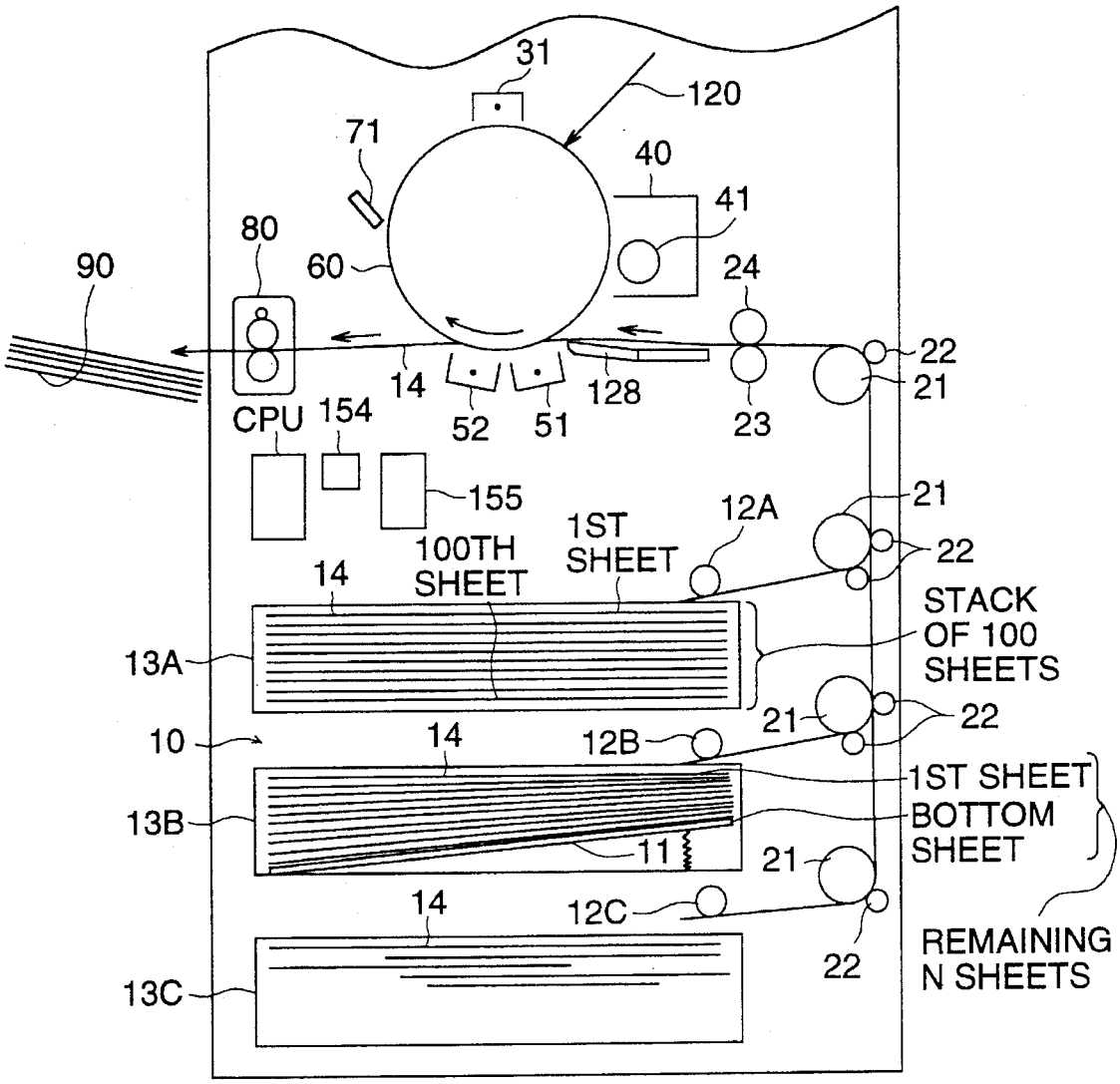
FIG. 1 is a general structural diagram of the invention.

In FIG. 1, a latent image formed on charged photoreceptor drum 60 through exposure by means of exposure beam 120 is developed first by developing roller 41 of developing unit 40 to be a toner image which is subjected to corona discharge generated by transfer electrode 51 and separation electrode 52 located respectively at a transfer position and a separation position, and is transferred onto transfer sheet 14 conveyed to the transfer position from sheet-feeding device 10 that feeds sheets one by one, then, the transfer sheet 14 is conveyed to fixing unit 80.

The conveyance speed for transfer sheet 14 is arranged to be identical to the peripheral speed of the photoreceptor drum 60 so that no relative slip between the transfer sheet 14 and the photoreceptor drum 60 may be caused for securing accurate transfer of a toner image.

In each of cassettes 13A, 13B and 13C containing respectively differently-sized transfer sheets in sheet-feeding device 10, there are stacked transfer sheets 14, and stacked transfer sheets 14 come into contact with each of feed-out rollers 12A, 12B and 12C while being pushed up by push-up plate 11. The feed-out roller feeds out the top transfer sheet which is conveyed by a pair of conveyance rollers 21 and 22 and by a pair of last-stage conveyance rollers 23 and 24, then further arrives at an end of conveyance guide member 128 provided in the vicinity of photoreceptor drum 60 through a conveyance guide in a straight section, and synchronizes with the photoreceptor drum 60 to be subjected to image transfer, as stated above.

The transfer sheet 14 which has been subjected to image transfer is further conveyed to fixing unit 80 having a function of heat fixing to be fixed, and delivered on delivery tray 90.

Next, the invention will be explained as follows, referring to a schematic diagram of control circuits in FIG. 2.

A copying apparatus is provided with means 100 for inputting information relating to thickness and material of a transfer sheet, and inputted information are stored in memory means 112 by CPU 111. Incidentally, for the inputting means 100 mentioned above, a ten-key array on an unillustrated operation panel of the apparatus may be used for inputting, or keys for exclusive use may be provided.

In the vicinity of sheet-feeding device 10, there is provided humidity-sensor 101.

Each of cassettes 13A, 13B and 13C in the sheet-feeding device 10 is provided with timer 102 that is for measuring a period of time during which transfer sheets stacked on each cassette are left. The timer may also be provided separately or CPU 111 may serve also as timer.

On the conveyance path for a transfer sheet covering from the sheet-feeding device 10 to transfer electrode 51, there is provided passing-sheet-sensor 103 which detects a pass of a transfer sheet. Incidentally, an ordinary jam sensor may serve also as the passing-sheet-sensor 103.

Each of cassettes 13A, 13B and 13C in sheet-feeding device 10 is provided with sheet-absence detecting sensor 104 for detecting existence of transfer sheets.

Each of cassettes 13A, 13B and 13C in sheet-feeding device 10 is provided with cassette mounting/dismounting detecting sensor 105 which detects that each cassette is taken out or inserted.

In this case, values outputted from the humidity sensor 101 are detected by CPU 111 periodically and stored in memory means 112. Depending on aging changes of stored output values, the CPU 111 judges that an environment where transfer sheets are left is on moisture-absorbing conditions or on moisture-releasing conditions respectively when the humidity is increasing or decreasing.

Timer 102 of each cassette generally starts measuring time when main power supply 106 of a copying apparatus is turned on, and the counting time operation is reset by both sheet-absence signals from the sheet-absence detecting sensor 104 and signals from the cassette mounting/dismounting detecting sensor 105 showing that a cassette has been taken out. The CPU detects, at predetermined intervals, the time measured by each timer 102 for each cassette, and stores it in the memory means 112. Namely, what predetermined signals have been outputted from the sheet-absence detecting sensor 104 or from the cassette mounting/dismounting detecting sensor 105 means that transfer sheets have been replaced or added. Therefore, it is considered that transfer sheets have started to be left newly, and the timer is reset accordingly.

Incidentally, since there is a possibility that a cassette is taken out momentarily for checking the inside thereof for existence of transfer sheets, it is also acceptable that predetermined signals are outputted from the cassette mounting/dismounting detecting sensor 105 only when the cassette is taken out and is left for a predetermined period of time (for example, 30 seconds).

In this case, the CPU 111 detects both information relating to thickness and material of a transfer sheet stored in the memory means 112 and a pass of a transfer sheet, judges an environment to be on moisture-absorbing conditions or on moisture-releasing conditions, calculates correction values for correcting a current for transferring for each transfer sheet, and stores the correction values in a command value table.

Furthermore, in synchronization with transferring onto a transfer sheet, the CPU controls constant current source 108 through D/A converter 113 in accordance with the correction values stored in the command value table so that a current for transferring flowing through transfer electrode 51 may take a predetermined value.

A method for determining a correction value for a current for transferring for each transfer sheet in the invention will be explained as follows, referring to Table 1 showing a change in the command value table and Table 2 showing correction data.

In this case, correction values for 20 transfer sheets from the top of a stack of transfer sheets on each cassette are determined. The transfer sheets of the 21st and thereafter are equally given the same value. The reason for this is that transfer sheets stacked on the upper part of the stack are most easily affected by ambient humidity.

For the 21st sheet and thereafter, the state of moisture-absorbing and the state of moisture-releasing do not make progress so fast, or they become the state with extremely small change. Only when the transfer sheets positioned in the lower part of a stack rise up to the part within 20 sheets from the top after the use of some transfer sheets, they are affected by moisture-absorbing and moisture-releasing. Therefore, the command value table wherein transfer sheets up to the 21st one are controlled is considered to be sufficient.

The command value table shown in Table 1 corresponds to a specific one cassette, and a command value table such as that shown in Table 1 is established thereon. Determination of correction values depends on whether the environment surrounding a stack of transfer sheets is on the moisture-absorbing condition or on the moisture-releasing condition, and Table 1 shows moisture-absorbing conditions.

Actually, a command value table identical to that of Table 1 is established for each cassette.

In ① of Table 1, there is shown an order of the transfer sheet in a stack (where the transfer sheet is from the top).

In ② of Table 1, there is shown a moment when transfer sheets started to be left, namely a moment when a timer was reset. Thus, an initial value of a is established in a command value table. Therefore, all of 0–20 as well as those exceeding 20 represent "0".

In ③ of Table 1, there is shown the condition when the transfer sheets have been left for 5 minutes. A correction value for the moment after the lapse of 0 minutes in ② of Table 1 is compared with correction data for the moment after the lapse of 5 minutes in **2*b*** of Table 2, and the greater one among them is established in the command value table as correction data. Accordingly, a correction value such as that shown in ③ of Table 1 is established in the command value table.

In ④ of Table 1, there is shown the condition when the transfer sheets have been left for 10 minutes. A correction value for the moment after the lapse of 5 minutes in ③ of Table 1 is compared with correction data for the moment after the lapse of 10 minutes in c of Table 2, and the greater one among them is established in the command value table as correction data. Accordingly, a correction value such as that shown in ④ of Table 1 is established in the command value table.

In ⑤ of Table 1, there is shown the condition when one copy is made after the lapse of 10 minutes. Since the transfer sheet with the order in a stack of "1" was used for copying, a correction value in ④ of Table 1 is shifted to the left by one step, and a correction value such as that shown in ⑤ of Table 1 is established in the command value table.

In ⑥ of Table 1, there is shown the condition when the transfer sheets have been left for 180 minutes after that. A correction value in ⑤ of Table 1 is compared with correction data for the moment after the lapse of 180 minutes in d of Table 2, and the greater one among them is established in the command value table as correction data. Accordingly, a correction value such as that shown in ⑥ of Table 1 is established in the command value table.

In ⑦ of Table 1, there is shown the condition when nine copies were made after that. Since the transfer sheets with the order in a stack of "1"–"9" were used for copying, a correction value in ⑥ of Table 1 is shifted to the left by nine steps, and a correction value such as that shown in ⑦ of Table 1 is established in the command value table.

In ⑧ of Table 1, there is shown the condition when the transfer sheets have been left for 5 minutes after that. A correction value in ⑦ of Table 1 is compared with correction data for the moment after the lapse of 5 minutes in a of Table 2, and the greater one among them is established in the command value table as correction data. Accordingly, a correction value such as that shown in ⑧ of Table 1 is established in the command value table.

In the case of Table 1 mentioned above, a correction value of a command value table was compared with correction data in Table 2 and the greater one was established for replacement in the command value table, because of the moisture-absorbing condition. In the case of the moisture-releasing condition, however, a correction value of the command value table is to be compared with correction data of Table 2 and the smaller one is to be established for replacement in the command value table.

TABLE 1

| | | Command value table | | | | | | | | | | | | | | | | | | | | |
|---|---|---|---|---|---|---|---|---|---|---|---|---|---|---|---|---|---|---|---|---|---|---|
| Image | | | | | | | | | | | | | | | | | | | | | | |
| ① Order in a stack | | 1 | 2 | 3 | 4 | 5 | 6 | 7 | 8 | 9 | 10 | 11 | 12 | 13 | 14 | 15 | 16 | 17 | 18 | 19 | 20 | OV20 |
| ② After lapse of 0 min. | | 0 | 0 | 0 | 0 | 0 | 0 | 0 | 0 | 0 | 0 | 0 | ... | | | | | | | | | |
| ③ After lapse of 5 min. | | 10 | 10 | 5 | 5 | 5 | 0 | 0 | 0 | 0 | 0 | 0 | 0 | 0 | 0 | 0 | 0 | ... | | | | |
| ④ After lapse of 10 min. | | 10 | 10 | 5 | 5 | 5 | 5 | 5 | 5 | 5 | 5 | 0 | 0 | 0 | 0 | 0 | 0 | ... | | | | |
| ⑤ After making 1 copy | | 10 | 5 | 5 | 5 | 5 | 5 | 5 | 5 | 5 | 0 | 0 | 0 | 0 | 0 | 0 | 0 | ... | | | | |
| ⑥ After lapse of 180 min. | | 10 | 10 | 10 | 10 | 10 | 10 | 10 | 10 | 10 | 10 | 5 | 5 | 5 | 5 | 5 | 5 | 5 | 5 | 5 | 5 | 5 |
| ⑦ After making 9 copies | | 10 | 5 | 5 | 5 | 5 | 5 | 5 | 5 | 5 | 5 | 5 | 5 | 5 | 5 | 5 | 5 | 5 | 5 | 5 | 5 | 5 |
| ⑧ After lapse of 5 min. | Correction | 10 | 10 | 5 | 5 | 5 | 5 | 5 | 5 | 5 | 5 | 5 | 5 | 5 | 5 | 5 | 5 | 5 | 5 | 5 | 5 | 5 |

TABLE 2

| | | Correction data | | | | | | | | | | | | | | | | | | | | |
|---|---|---|---|---|---|---|---|---|---|---|---|---|---|---|---|---|---|---|---|---|---|---|
| Image<br>Order in a stack | | 1 | 2 | 3 | 4 | 5 | 6 | 7 | 8 | 9 | 10 | 11 | 12 | 13 | 14 | 15 | 16 | 17 | 18 | 19 | 20 | OV20 |
| a Initial value | | 0 | 0 | 0 | 0 | 0 | 0 | 0 | 0 | 0 | 0 | 0 | ... | | | | | | | | | |
| b After lapse of 5 min. | 5 min. | 10 | 10 | 5 | 5 | 5 | 0 | 0 | 0 | 0 | 0 | 0 | 0 | 0 | 0 | 0 | 0 | ... | | | | |
| c After lapse of 10 min. | 10 min. | 10 | 10 | 5 | 5 | 5 | 5 | 5 | 5 | 5 | 5 | 0 | 0 | 0 | 0 | 0 | 0 | ... | | | | |
| . | | | | | | | | | | | | | | | | | | | | | | |
| . | | | | | | | | | | | | | | | | | | | | | | |
| . | | | | | | | | | | | | | | | | | | | | | | |
| d After lapse of 180 min. | OV 180 | 10 | 10 | 10 | 10 | 10 | 10 | 10 | 10 | 10 | 10 | 5 | 5 | 5 | 5 | 5 | 5 | 5 | 5 | 5 | 5 | 5 |

TABLE 3

| Percentage of moisture content of sheet | Not more than 8% | 8%–9% | Not less than 9% |
|---|---|---|---|
| Current value for transferring | 180 μA | 190 μA | 200 μA |
| Correction value | 0 | 5 | 10 |

Referring to Table 3, there will be explained as follows the relation between a correction value established in a command value table obtained through the aforementioned method and control of a current for transferring.

As stated above, the value representing a correction value includes "0", "5" and "10".

As shown in Table 1, in synchronization with image transfer for a transfer sheet conducted in accordance with the correction value established in a command value table for the transfer sheet, a value of a current for transferring corresponding to the correction value is established due to the relation shown in Table 3. The current value for transferring thus established controls constant current source 108 through D/A converter 113 so that desired current for transferring may be supplied to transfer electrode 51.

Thus, it is possible to obtain an optimum current for transferring for each transfer sheet.

Incidentally, the relation between a correction value in Table 3 and a value of a current for transferring has been obtained from the results of experiments shown in FIG. 3.

In addition, each correction value corresponds also to the percentage of moisture content of a transfer sheet such as what is shown in Table 3.

In the foregoing, there has been explained a method wherein a correction value is obtained by the use of a command value table of Table 1 and a value of a current for transferring is determined from the relation in Table 3. Now, there will be explained as follows a method wherein the trial percentage of moisture content of a sheet is obtained from an approximate expression obtained experimentally and a value of a current for transferring is determined from the relation of Table 3.

Figure 4:
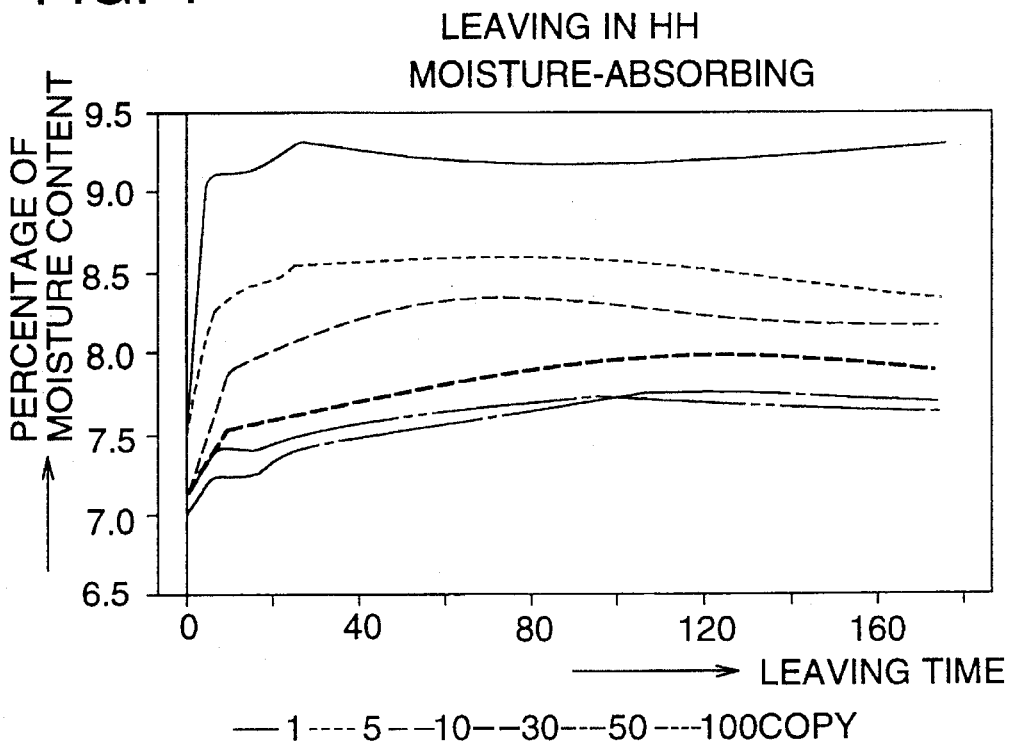
FIG. 4 is a diagram showing the percentage of moisture content of a transfer sheet under the condition of high temperature and high humidity (HH).

FIG. 4 is a diagram showing the results of measurement of the percentage of moisture content of each transfer sheet in an ambience of high temperature and high humidity (HH). To be concrete, the diagram was prepared by measuring each percentage of moisture content at constant intervals for the 1st, 5th, 10th, 30th, 50th and 100th transfer sheets which are stacked on a cassette or the like.

Figure 5:
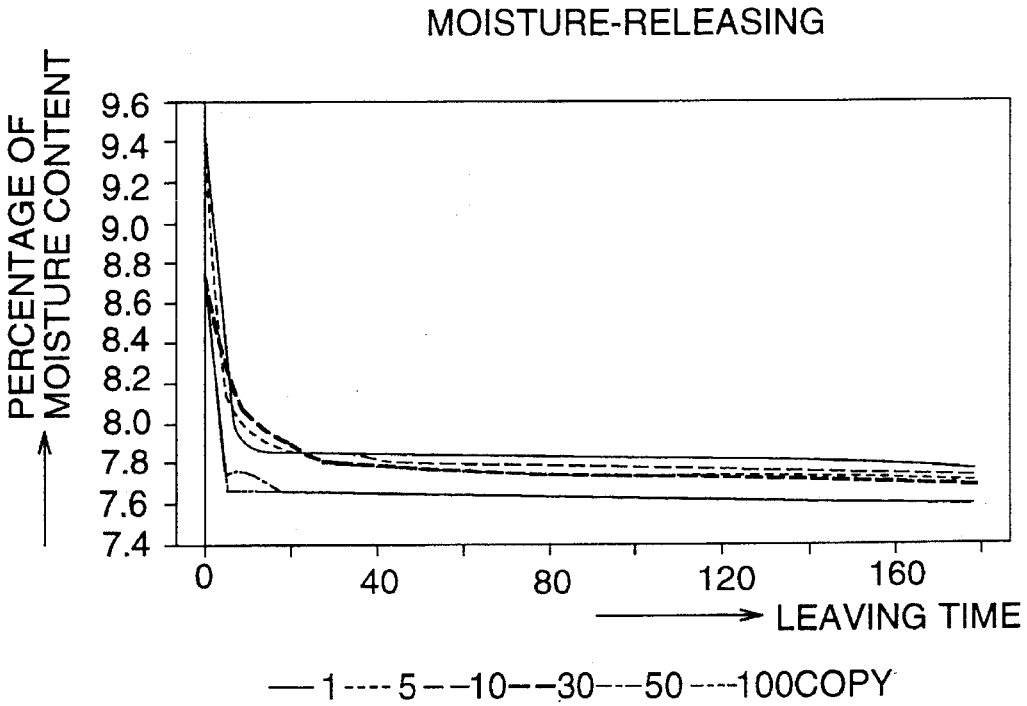
FIG. 5 is a diagram showing the percentage of moisture content of a transfer sheet under the condition of normal temperature and normal humidity (NN).

FIG. 5 is a diagram showing the results of measurement of the percentage of moisture content of each transfer sheet in an ambience of normal temperature and normal humidity (NN). To be concrete, the diagram was prepared by measuring each percentage of moisture content at constant intervals for the 1st, 5th, 10th, 30th, 50th and 100th transfer sheets which are stacked on a cassette or the like.

Both curves of the percentage of moisture content of each transfer sheet in FIGS. 4 and 5 approximate extremely to an exponential function.

FIG. 4 shows the moisture-absorbing condition wherein the percentage of moisture content of a transfer sheet rises gradually, while FIG. 5 shows the moisture-releasing condition wherein the percentage of moisture content of a transfer sheet falls gradually, In the case of FIG. 4, the relation of $x_1>x_0$ is satisfied when $x_0$ represents the percentage of moisture content before moisture-absorbing and $x_1$ represents the saturation percentage of moisture content, $x_0$ is 7%, for example, the percentage of moisture content between $x_0$ and $x_1$ depends upon where the sheet is in a stack and where the sheet is from the top of the stack, and the percentage of moisture content y shown after the lapse of an arbitrary period of time can be obtained by an expression of $$y=(x_0-x_1)\exp(-t/\tau)+x_1$$

wherein, τ represents a time constant, and it is possible to make the expression to approximate nicely to the graph in FIG. 4 representing the results of experiments mentioned above, by selecting the value of τ.

Under the condition mentioned above, relations among saturation percentage of moisture content $x_1$(%), y intercept (%) at time constant and the time constant τ (min.) indicate what is shown in FIG. 4.

TABLE 4

| Number of sheet | Items: Saturation value (%) $x_1$ | Time constant τ (min.) | Percentage of moisture content before moisture-absorbing (%) $x_0$ |
|---|---|---|---|
| 1 to 4 | 9.5 | 3.8 | 7.3 |
| 5 to 9 | 9.3 | 20 | 7.2 |
| 10 to 29 | 9.0 | 40 | 7.1 |
| 30 to 49 | 8.6 | 110 | 7.1 |
| 50 to 99 | 8.5 | 400 | 6.9 |
| Not less than 100 | 8.4 | 400 | 7.1 |

In the case of FIG. 5, the relation of $x_0>x_1$ is satisfied when $x_0$ represents the percentage of moisture content before moisture-releasing and $x_1$ represents the moisture-releasing saturation percentage of moisture content, $x_1$ is 7%, for example, the percentage of moisture content between $x_0$ and $x_1$ depends upon where the sheet is in a stack and where the sheet is from the top of the stack, and the percentage of moisture content y' shown after the lapse of an arbitrary period of time can be obtained by an expression of $$y'=(x_0-x_1)\exp(-t/\tau)+x_1$$

wherein, τ represents a time constant, and it is possible to make the expression to approximate nicely to the graph in FIG. 5 representing the results of experiments mentioned above, by selecting the value of τ.

Namely, under the condition mentioned above, relations among saturation percentage of moisture content $x_1$(%), y intercept (%) at time constant and the time constant τ (min.) indicate what is shown in FIG. 5.

TABLE 5

| Number of sheet | Items: Percentage of moisture content before moisture-releasing $x_0$ (%) | Time constant τ (min.) | Saturation value (%) $x_1$ |
|---|---|---|---|
| 1 to 4 | 9.5 | 3.7 | 7.8 |
| 5 to 9 | 9.3 | 4.0 | 7.8 |
| 10 to 29 | 9.0 | 4.3 | 7.8 |
| 30 to 49 | 8.6 | 4.3 | 7.8 |
| 50 to 99 | 8.4 | 3.3 | 7.6 |
| Not less than 100 | 8.7 | 2.8 | 7.6 |

A judgment of moisture-absorbing condition or moisture-releasing condition is formed by comparing the humidity obtained through measurement conducted at constant intervals with the preceding measurement value, and it is determined by the expression of exponential function used. Next, by using a sheet-leaving period of time that is a lapse of time from the initial state and a parameter corresponding to the number of conveyed sheets obtained from the tables such as Table 4 and Table 5, the percentage of moisture content of a transfer sheet is obtained from the aforementioned exponential function, and an appropriate current value for transferring can be obtained from the table for current values for transferring corresponding to the aforesaid percentage of moisture content.

Independently of moisture-absorbing and moisture-releasing, it is possible to obtain stably the copies with high image quality free from transfer failure or blurred transfer by obtaining an accurate current value for transferring corresponding to the estimated percentage of moisture content of the transfer sheet at that moment through a combination of a figure calculating system of the exponential function with an operation means, without using a table for command values and their correction values.

The table mentioned above and the expression of exponential function may naturally be used in combination. With the aforementioned expression of exponential function built in the operation means, data of the humidity measured at the last moment can be stored and then are compared with data of the humidity measured at the moment of turning on the copying apparatus again, thereby an ambience is judged whether it is of moisture-absorbing or it is of moisture-releasing. Thus, it is possible to decide automatically the selection of the expression of exponential function either to moisture-absorbing or to moisture-releasing.

In addition, owing to the foregoing, it is possible to decide automatically the selection either to moisture-absorbing or to moisture-releasing when a table of current values for transferring is used in combination.

The foregoing is related to the occasion wherein a transfer sheet is of a normal thickness and a normal material. For the transfer sheet that is of a special thickness and a special material, it is necessary to correct command values.

Namely, since the percentage of moisture content and resistance value R are considered to be functions of both sheet thickness t and material c, the expression of $$R=f(t, c)$$

is satisfied, and when resistance values of an ordinary sheet and a special sheet are represented respectively by $R_1$ and $R_2$, the relation of $$R_2/R_1=f_2(t_2, c_2)/f_1(t_1, c_1)$$

is satisfied. Therefore, it has become possible to correct command values by multiplying them by $R_2/R_1$.

When physical properties information of transfer sheets are stored in CPU as shown in circuit diagrams in FIG. 2 to be inputted manually from an operation panel, resistance values based on the physical properties data stored independently of speciality and current values for transferring are compared with those of ordinary sheets and corrected, thereby command values can be corrected to be those capable of bringing about high image quality in a stable manner.

Therefore, automatic correction by means of correction of command values can be made independently of normal transfer sheets and special transfer sheets, and thereby optimum current values for transferring can be obtained constantly.

When detecting that all transfer sheets in a cassette have been used up or when a cassette still containing some transfer sheets is taken out by mistake or on purpose and a predetermined period of time of 30 seconds or more has passed, the aforementioned command value prepared for the transfer sheet through its order in a stack of transfer sheets on the cassette and a lapse of time for it and time elapsing information for the transfer sheet to be compared with a correction value for the command value mentioned above in a table are reset so that the cassette may show its initial state when that cassette is loaded with transfer sheets and mounted again.

Owing to the foregoing, transfer sheet information are always compared properly with those in a command value table (including also correction values), and the correct percentage of moisture content, namely the correct resistance value is estimated so that correct current for transferring may be outputted. Thus, copies with high image quality which are free from transfer failure and blurred transfer can be obtained stably and continuously.

The invention has successfully eliminated obstacles for handling of an electrophotographic copying apparatus in a district where both temperature and humidity are high, resulting in copies with high image quality which can be obtained constantly. Namely, changing conditions of the percentage of moisture content and a resistance value of transfer sheets stacked in a high humidity ambience are tabulated based on information of the results of experiments about thicknesses and materials of normal and special transfer sheets so that they may correspond to optimum current values for transferring relating to the lapse of time as well as a position and an order of each passing transfer sheet. In addition, when copying, data of humidity measurement and positional information of each transfer sheet inputted each time are checked with the tabulated information mentioned above, and are subjected to operation conducted by an operational means of CPU incorporated, and they are caused to follow also changes in thickness and material of transfer sheets. Furthermore, when all transfer sheets in a cassette have been used up, or when a cassette still containing transfer sheets is taken out of a copying apparatus before the end of copying operation, information relating to a position of a transfer sheet and to an order of the transfer sheet as well as timer information are reset temporarily so that the cassette may not be set to its initial state unless the cassette is loaded again into the copying apparatus. Incidentally, in other method for coping with the aforementioned optimum current values, it is possible to replace changes with time of the percentage of moisture content with exponential functions, to select the exponential function depending on whether an ambience condition is moisture-absorbing or moisture-releasing, and to obtain the optimum current value for transferring from the percentage of moisture content calculated by the use of the exponential function. Therefore, it has become possible to constantly supply the optimum current for transferring without an error, and thereby to obtain stably the copies with high image quality free from transfer failure and blurred transfer.

What is claimed is:

1. An electrophotographic copying apparatus, comprising:

an electric power source to supply a corona discharging output to an electrode;

stack means on which transfer sheets to be fed are stacked;

a time counter to count a time during which the transfer sheets are left in the stack means;

means for storing an output value of a humidity detector;

a calculator to calculate a correction value for each transfer sheet in accordance with the output value of the humidity detector and the time counted by the time counter; and control means for controlling the corona discharging output for each transfer sheet in accordance with the correction value.

2. The electrophotographic copying apparatus of claim 1, wherein the calculator calculates the correction value in accordance with the stacked order of each transfer sheet.

3. The electrophotographic copying apparatus of claim 1, further comprising:

detecting means for detecting a mounting or dismounting of the stack means and for outputting a dismount signal to indicate the dismounting of the stack means; and means for resetting the counting of the time counter in response to the dismount signal.

4. The electrophotographic copying apparatus of claim 3, wherein, when the stack means is mounted again within a given time after the stack means has been dismounted, the detecting means does not output the dismount signal.

5. The electrophotographic copying apparatus of claim 1, further comprising:

sheet detection means for detecting the presence or absence of the sheet on the stack means and for outputting a no-sheet signal when detecting the absence of the sheet; and means for resetting the counting of the time counter in response to the no-sheet signal.

6. The electrophotographic copying apparatus of claim 1, further comprising means for determining a moisture-absorbing state or a moisture-releasing state of the transfer sheets from the output value of the humidity detector; and means for changing a calculation method of the calculation means in accordance with a determination result of the determining means.

7. The electrophotographic copying apparatus of claim 6, wherein the determining means determines the moisture-absorbing state or the moisture-releasing state of the transfer sheets from the output values of the humidity detector during times that the main power source of the electrophotographic copying apparatus is ON and OFF.

8. The electrophotographic copying apparatus of claim 1, wherein the electrode comprises a transfer electrode.

9. The electrophotographic copying apparatus of claim 1, wherein the electrode comprises a separation electrode.

* * * * *